US006607407B2

(12) United States Patent
Takatsuki et al.

(10) Patent No.: US 6,607,407 B2
(45) Date of Patent: Aug. 19, 2003

(54) CONNECTOR WITH RETAINER

(75) Inventors: Kozue Takatsuki, Yokkaichi (JP); Hajime Kawase, Yokkaichi (JP); Ryotaro Ishikawa, Yokkaichi (JP); Yuuichi Nankou, Yokkaichi (JP)

(73) Assignee: Sumitomo Wiring Systems, Ltd. (JP)

( * ) Notice: Subject to any disclaimer, the term of this patent is extended or adjusted under 35 U.S.C. 154(b) by 0 days.

(21) Appl. No.: 09/985,161

(22) Filed: Nov. 1, 2001

(65) Prior Publication Data

US 2002/0052153 A1 May 2, 2002

(30) Foreign Application Priority Data

Nov. 1, 2000 (JP) ..... 2000-334891

(51) Int. Cl.[7] ..... H01R 13/514
(52) U.S. Cl. ..... 439/752; 439/271; 439/595
(58) Field of Search ..... 439/752, 595–600, 439/271

(56) References Cited

U.S. PATENT DOCUMENTS 5,211,583 A * 5/1993 Endo et al. ..... 439/595
5,252,088 A * 10/1993 Morello et al. ..... 439/271
5,439,397 A * 8/1995 Yamanashi et al. ..... 439/752
5,713,760 A 2/1998 Chemin
5,738,551 A * 4/1998 Matsuoka ..... 439/752
5,989,066 A 11/1999 Cox

FOREIGN PATENT DOCUMENTS

EP 0 716 475 6/1966
EP 0 827 236 3/1998

* cited by examiner

*Primary Examiner*—Hien Vu
*Assistant Examiner*—Truc Nguyen
(74) *Attorney, Agent, or Firm*—Banner & Witcoff, Ltd.

(57) ABSTRACT

A connector including a connector housing with a retainer attachment hole that receives and stabilizes a retainer as it is inserted into the connector housing. The retainer attachment hole extends into an anterior face of the connector housing. Male terminal fittings inserted into the connector housing are maintained therein by a removal preventing member of the retainer that is inserted into the retainer attachment hole. Guiding members formed on the retainer enter the retainer attachment hole before the removal preventing member enters therein. Consequently, the retainer is stabilized and maintained in position relative to the connector housing while it is being attached to the retainer attachment hole.

12 Claims, 10 Drawing Sheets

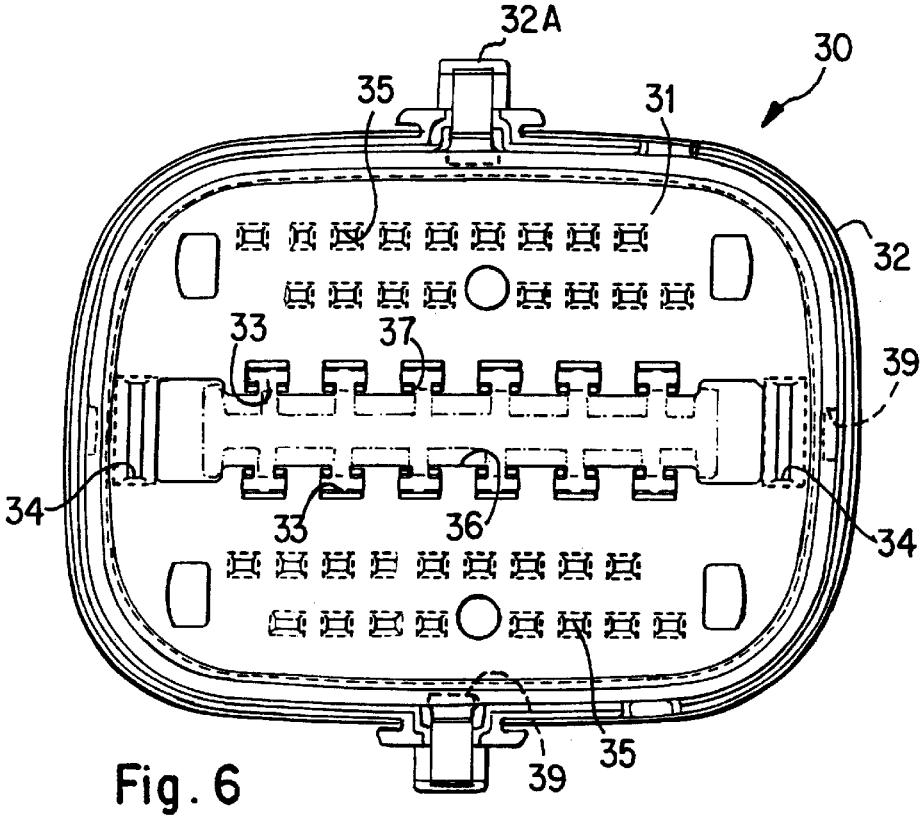
Fig. 6
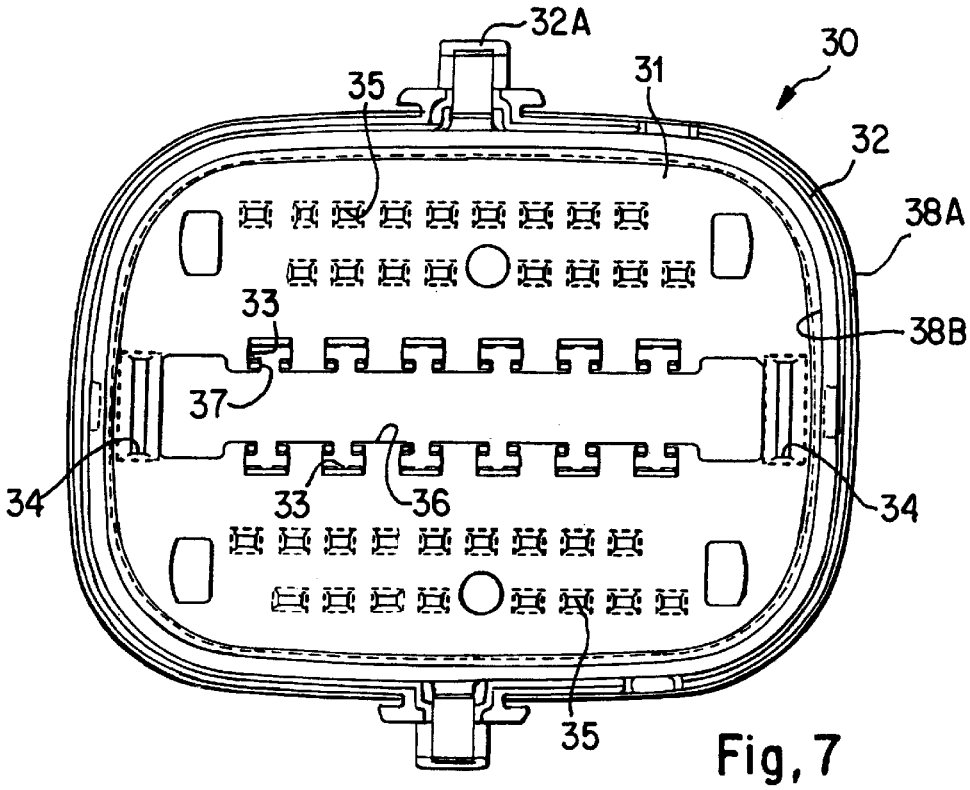
Fig, 7

CONNECTOR WITH RETAINER

TECHNICAL FIELD

The present invention relates to an electrical connector provided with a retainer.

BACKGROUND TO THE INVENTION

One example of a connector provided with a retainer for retaining terminal fittings has the retainer attached from the anterior to a connector housing which houses terminal fittings, this retainer retaining the terminal fittings. This type of conventional connector provided with a retainer is described in JP 11-97098.

In this connector, wherein a front retainer is attached to the connector housing from the anterior, a cylindrical guiding member is formed on the retainer. This cylindrical guiding member fits with the exterior of the connector housing, thereby fixing the position of the retainer relative to the connector housing, and stabilising the retainer while it is being attached thereto.

However, stabilising the retainer or fixing its position have proved problematic in the case where a retainer is housed within the retainer attachment hole formed in an anterior face of the connector housing.

The present invention has taken the above problem into consideration and aims to stabilise and fix the position of this retainer in a connector to which a retainer is attached by being inserted into a retainer attachment hole that opens onto an anterior face of a connector housing.

SUMMARY OF THE INVENTION

According to the invention there is provided an electrical connector comprising a housing having a terminal fitting exposed at one side thereof for connection to a corresponding terminal of a mating connector, and a retainer insertable into a retainer attachment hole of said housing from said one side to retain said terminal fitting in said housing, characterised in that said retainer has a plate-like preventing member for retaining said terminal fitting, and a protruding guiding member, said guiding member being adapted to enter said attachment hole in advance of said preventing member to stabilise said retainer therein.

Since the guiding member enters the retainer attachment hole in advance of the preventing member, movement of the retainer is stabilised, and the retainer can move smoothly and easily.

In a preferred embodiment the preventing member is inserted between upper and lower terminal fittings so that a single preventing member can retain two such fittings.

Preferably a plurality of preventing members are arranged side by side for engagement with an upper and lower row of terminal fittings. In such an arrangement a guiding member is preferably provided at each end of the retainer. The guiding member preferably extends substantially at right angles to length of the retainer and in the insertion direction thereof.

BRIEF DESCRIPTION OF DRAWINGS

Other features of the invention will be apparent from the following description of a preferred embodiment shown by way of example only in the accompanying drawings in which:

FIG. 6 is a front view showing the retainer fitted through a window hole of a moving plate.

FIG. 7 is a front view of the moving plate.

DESCRIPTION OF PREFERRED EMBODIMENT

Figure 1:
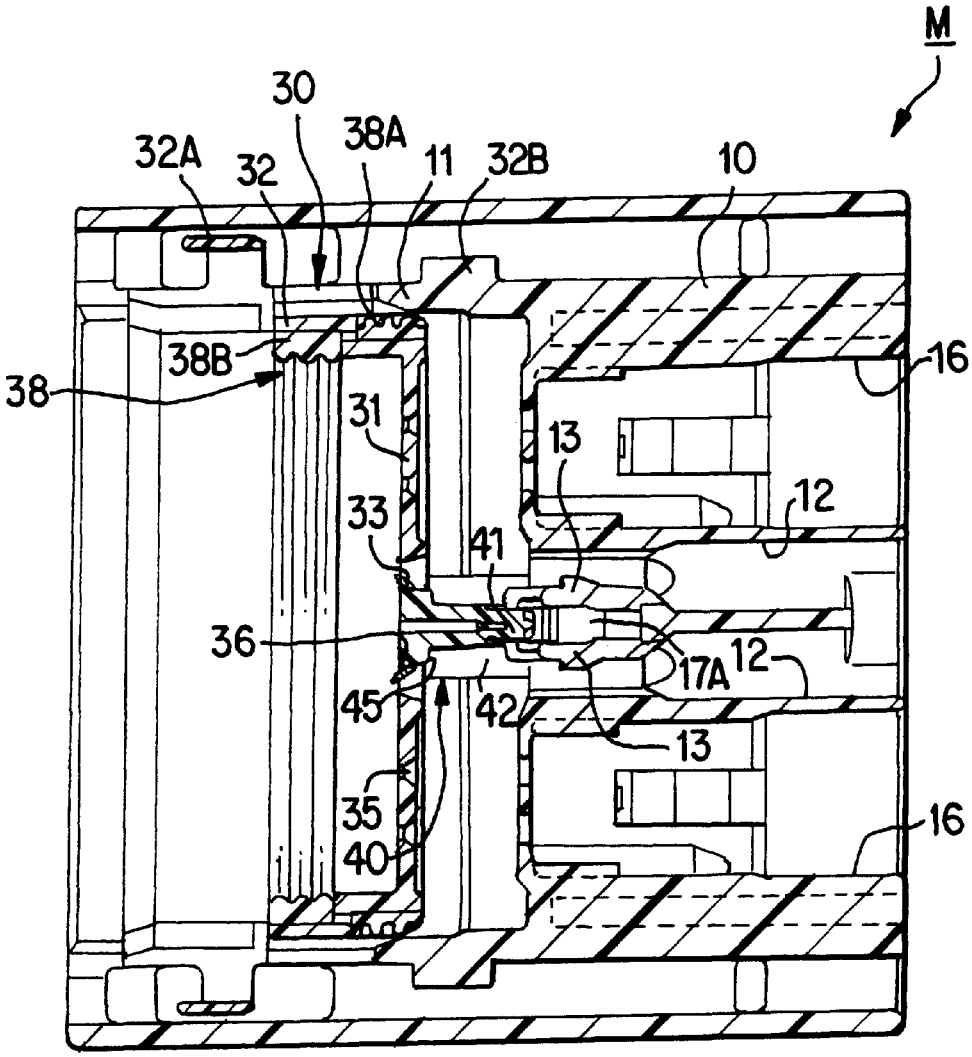
FIG. 1 is a horizontal cross-sectional view showing a retainer in a temporary retaining state.
Figure 2:
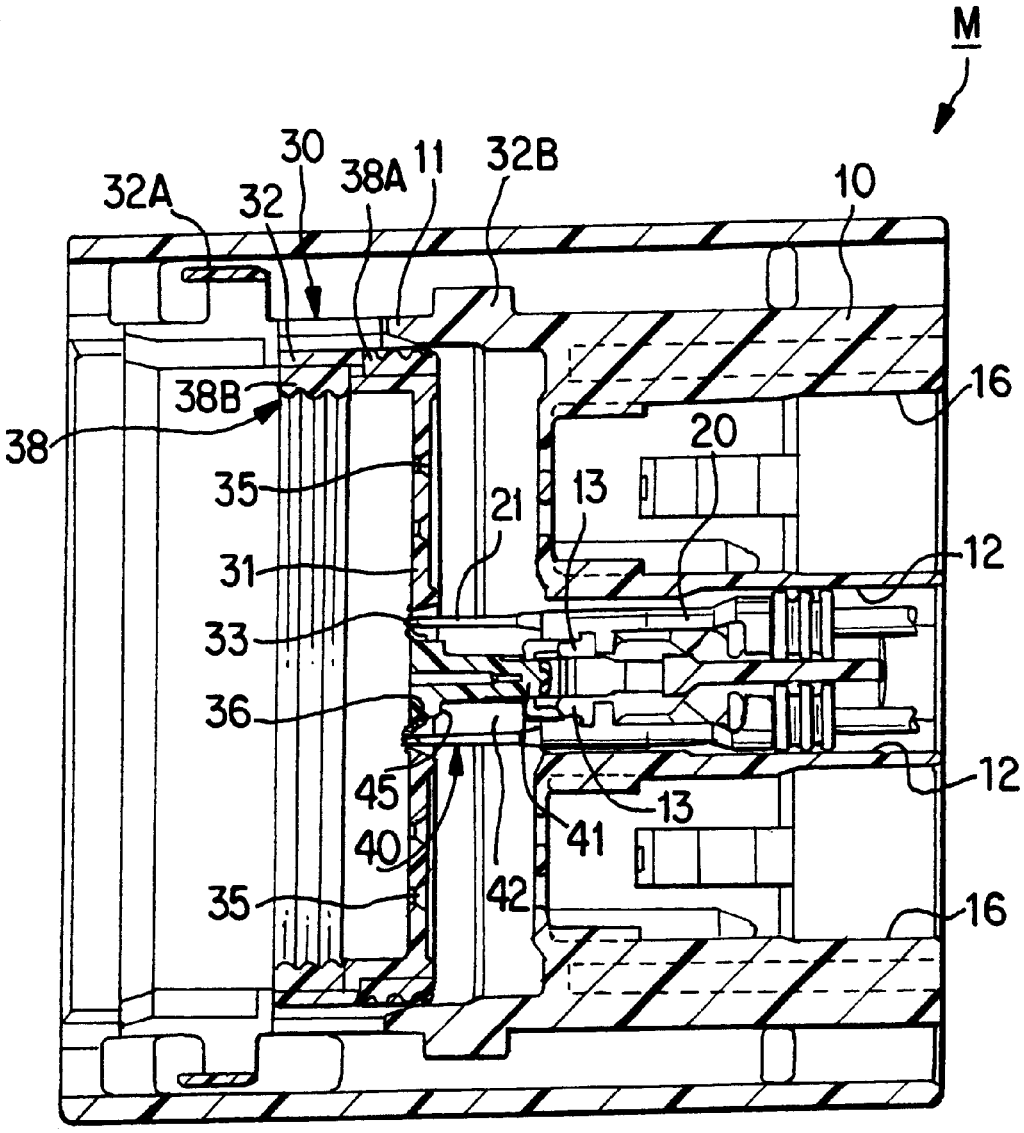
FIG. 2 is a horizontal cross-sectional view showing terminal fittings in an inserted state whereby they are temporarily retained by the retainer.
Figure 3:
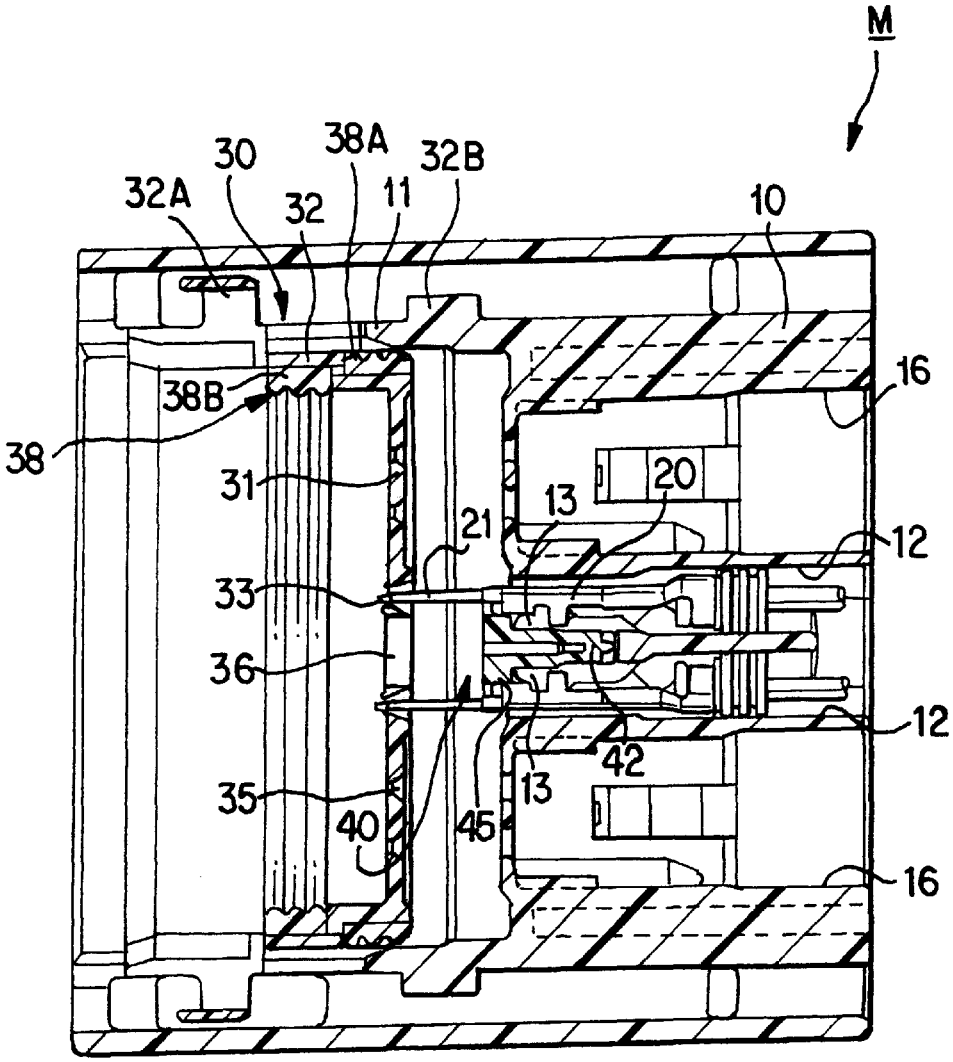
FIG. 3 is a horizontal cross-sectional view showing the retainer in a main retaining state.

An embodiment of the present invention is described below with the aid of FIGS. 1 to 15.

A connector M of the present embodiment is provided with a connector housing 10, male terminal fittings 20, a moving plate 30, and a retainer 40. In the following description, the anterior direction is on the left side with reference to FIG. 1, and the up-down direction is also taken with reference to FIG. 1.

The connector housing 10 is formed from plastic. A hood 11 protrudes to the anterior from an outer circumference of an anterior end face of this connector housing 10. A plurality of cavities 12 are formed within the connector housing 10, these cavities 12 being located therein in an approximately central location relative to the up-down direction thereof, and being horizontally aligned in an upper and a lower row. The male terminal fittings 20, which are inserted into these cavities 12, are doubly retained therein by plastic lances 13 and the retainer 40. Large diameter cavities 14 are formed to the left and right of the two rows of cavities 12. Terminal fittings (not shown) inserted into these large diameter cavities 14 are retained only by plastic lances 15. Housing grooves 16, into which sub connectors (not shown) are fitted from the posterior, are formed above and below the cavities 12.

The upper and lower rows of cavities 12 are symmetrical. The plastic lances 13 are formed in the anterior end portions thereof and extend towards the anterior in a cantilevered shape. The plastic lances 13 of the upper rows extend along lower faces of the cavities 12, and the plastic lances 13 of the lower rows extend along upper faces of the cavities 12. Bending spaces 17A, which allow the plastic lances 13 to bend resiliently, are formed between the upper and lower rows of plastic lances 13 and open onto an anterior end face of the connector housing 10. The plastic lances 13 bend resiliently into the bending spaces 17A as a result of making contact with the male terminal fittings 20 while these are being inserted from the posterior into the cavities 12. This contact is released after the male terminal fittings 20 have been inserted to a correct position, the plastic lances 13 return resiliently to their original position and engage with the male terminal fittings 20, thereby retaining them. After the male terminal fittings 20 have been inserted, tabs 21 at anterior ends thereof protrude from the anterior end face of the connector housing 10 into the hood 11.

The bending spaces 17A join with one another between the adjacent cavities 12, thereby forming, in their entirety, a long and narrow slit that extends in a left-right direction. When the bending spaces 17A are in a free state, whereby the plastic lances 13 have not bent resiliently therein, a removal preventing member 41 of the retainer 40 can be fitted into the bending spaces 17A from the anterior in a manner whereby this removal preventing member 41 does not rattle up or down. Furthermore, a left and right pair of guiding holes 17B is formed at the left and right sides, respectively, of the bending spaces 17A. These guiding holes 17B join with the bending spaces 17A and open into the anterior end face of the connector housing 10. Guiding members 42 of the retainer 40 can be fitted into these guiding holes 17B in a manner whereby they do not rattle in the up-down or left-right directions. The bending spaces 17A and the guiding holes 17B form a retainer attachment hole 17. Moreover, temporary retaining receiving members 18A and main retaining receiving members 18B protrude from inner side faces of the guiding holes 17B. Stopping members 43 of the retainer 40 engage with these receiving members 18A and 18B, thereby maintaining the retainer 40 in a temporary retaining position and a main retaining position, respectively, relative to the connector housing 10. Further, the anterior end face of the connector housing 10, into which the retainer attachment hole 17 opens, refers to the inner face of the hood 11.

Next, the moving plate 30 will be described. The moving plate 30 is made from plastic, and fixes the position of the tabs 21 of the male terminal fittings 20 (these tabs 21 protrude from the anterior end face of the connector housing 10 into the hood 11). The moving plate 30 is formed in a unified manner from a sheet-shaped plate main body 31, which is parallel to and has the same shape as the anterior end face of the connector housing 10, and a guiding cylindrical member 32 that protrudes towards the anterior from the outer circumference of the plate main body 31 and makes contact with the inner circumference of the hood 11. The plate main body 31 is provided with position fixing holes 33, 34 and 35. The tabs 21 of the male terminal fittings 20 that have been inserted into the upper and lower rows of cavities 12 pass through the position fixing holes 33. Tabs protruding from male terminal fittings (not shown) of the sub connectors fitted into the housing grooves 16 pass through the position fixing holes 34. Tabs of the male terminal fittings (not shown) inserted into the large diameter cavities 14 pass through the position fixing holes 35.

A window hole 36, which connects with the bending spaces 17A and the guiding holes 17B of the connector housing 10, passes through the plate main body 31 from the anterior face to the posterior face thereof. The shape and dimensions of the window hole 36 are such that the retainer 40 can be passed therethrough. The window hole 36 is located between the rows of position fixing holes 33 (the tabs 21 of the male terminal fittings 20 inserted into the upper and lower rows of cavities 12 are passed through these position fixing holes 33). Recessed members 37 are formed at upper and lower edges of the window hole 36, each recessed member 37 joining individually with one of the position fixing holes 33. Supporting members 45 of the retainer 40 pass through these recessed members 37.

A sealing member 38 is formed in a unified manner on the guiding cylindrical member 32 of the moving plate 30. This sealing member 38 is formed from an outer circumference sealing member 38A, which extends along an outer circumference of a posterior end portion of the guiding cylindrical member 32 (i.e., the portion thereof close to the plate main body 31), and an inner circumference sealing member 38B, this being located further towards the anterior than the outer circumference sealing member 38A and extending along an inner circumference of the guiding cylindrical member 32. These sealing members 38A and 38B are connected via a plurality of joining holes 39 formed at intervals along the circumference thereof.

A cam pin receiving member 32A is formed in each of the upper and lower sides of the guiding cylindrical member 32. While the connector M is being fitted with a corresponding connector F, cam pins (not shown) of this corresponding connector F fit into the cam pin receiving members 32A to form a unified state, then are fitted into cam grooves of a lever (not shown). The lever is rotated using rotative axes 32B of the guiding cylindrical member 32 as its centre, the cam operation causing the corresponding connector F to become unified with the moving plate 30 and to be drawn towards the connector housing 10 until a fitted state is reached.

The retainer 40 is made from plastic, and is moulded in a unified manner so that it has the removal preventing member 41 that extends as a long horizontal plate in a left-right direction, and the pair of guiding members 42 that are formed on the left and right ends of the removal preventing member 41, these guiding members 42 having long plate-shaped faces which extend in an anterior-posterior direction and are formed at approximate right angles to the removal preventing member 41. Both the removal preventing member 41 and the guiding members 42 form an approximately unified face at the anterior end face of the retainer 40. However, posterior end portions of the guiding members 42 protrude further towards the posterior (the direction in which the retainer 40 is attached to the connector housing 10) than the removal preventing member 41.

The stopping members 43 are formed as an anterior and posterior protruding pair in each of outer side faces of the posterior end portions of the guiding members 42 (i.e., those portions protruding to the posterior relative to the removal preventing member 41). The stopping members 43 fit with the temporary retaining receiving members 18A of the guiding holes 17B in a manner whereby they grip into the temporary retaining receiving members 18A from the anterior and posterior sides thereof, thereby maintaining the retainer 40 in the temporary retaining position relative to the connector housing 10. When the retainer 40 is in the temporary retaining position, the removal preventing member 41 is not in an inserted state within the bending spaces 17A. Consequently, the plastic lances 13 are able to bend resiliently into these bending spaces 17A, allow the male terminal fittings 20 to be inserted into or removed from the cavities 12.

When the retainer 40 is pushed inwards from the temporary retaining position to the main retaining position, the stopping members 43 fit with the main retaining receiving members 18B of the guiding holes 17B in a manner whereby they grip the anterior and posterior sides thereof, this maintaining the retainer 40 in the main retaining position relative to the connector housing 10. When the retainer 40 is in the main retaining position, the removal preventing member 41 is fitted into the bending spaces 17A in such a manner that it does not rattle. Consequently, the plastic lances 13 are prevented from bending resiliently towards the bending spaces 17A (i.e., in the direction for removing the male terminal fittings 20), thereby preventing the male terminal fittings 20 from being removed.

Further, the posterior end portions of the guiding members 42 (i.e., the tips thereof relative to the direction in which the retainer 40 is attached to the retainer attachment hole 17) grow gradually smaller in the up-down direction, forming tapered guiding tips 44. The anterior end portion of the removal preventing member 41 has the supporting members 45 formed thereon at locations corresponding to the cavities 12 (i.e., corresponding to each plastic lance 13), these supporting members 45 protruding upwards and downwards, respectively. When the retainer 40 is in the main retaining position, these supporting members 45 make contact, via the bending spaces 17A, with the anterior end portions of the male terminal fittings 20. Consequently, the anterior end portions of the male terminal fittings 20 are prevented from inclining towards the bending spaces 17A, thereby maintaining the male terminal fittings 20 in a stable position. Moreover, when the retainer 40 is in the main retaining position, the supporting members 45 make contact with anterior ends of the plastic lances 13, thereby functioning as stoppers which prevent the retainer 40 from being pushed in too far.

The present embodiment is configured as described above. Next, the operation thereof will be described.

When the connector M of the present embodiment is to be assembled, the moving plate 30 is first housed within the hood 11 (see FIG. 1). The moving plate 30 is maintained in a fitting waiting position located to the anterior of the anterior end face of the connector housing 10, a space remaining between the two. Next, the retainer 40 is attached, in a temporary retaining state, to the connector housing 10 by being passed through the window hole 36 of the moving plate 30. At this juncture, posterior end portions of the guiding members 42 of the retainer 40 are fitted into the guiding holes 17B of the retainer attachment hole 17, and the stopping members 43 of the retainer 40 engage with the temporary retaining receiving members 18A. By this means, the retainer 40 is maintained in the temporary retaining position (see FIG. 1). The retainer 40 is located such that the anterior end face thereof forms an approximately unified face with the anterior end face of the plate main body 31 of the moving plate 30.

From this state, the male terminal fittings 20 are inserted into the cavities 12 and are retained by the plastic lances 13. Moreover, the tips of the tabs 21 protruding from the anterior end face of the connector housing 10 are fitted into the position fixing holes 33 of the moving plate 30 (see FIG. 2). By this means, the tabs 21 are maintained in a state whereby they do not move in the up-down or left-right directions, and are ready to be fitted with female terminal fittings (not shown) of the corresponding connector F.

After all the male terminal fittings 20 have been fitted, the retainer 40 is pushed in from the temporary retaining position to the main retaining position. This may be done by pushing, with a finger, the anterior end face of the retainer 40 that is protruding from the window hole 36 of the moving plate 30. After the retainer 40 has been pushed to the main retaining position, the removal preventing member 41 fits within the bending spaces 17A, thereby preventing the plastic lances 13 from bending resiliently in the direction that allows the male terminal fittings 20 to be removed. By this means, the male terminal fittings 20 are maintained in a doubly retained state within the cavities 12, being retained by the plastic lances 13 and doubly retained by the retainer 40.

After the connector has been assembled in the manner described above, the corresponding connector F may be fitted into the hood 11. The corresponding connector F and the moving plate 30 are moved as a single unit while the corresponding connector F is being fitted, and the tabs 21 that are maintained in position by the position fixing holes 33 of the moving plate 30 are reliably fitted together with and make contact with the female terminal fittings of the corresponding connector F.

Figure 4:
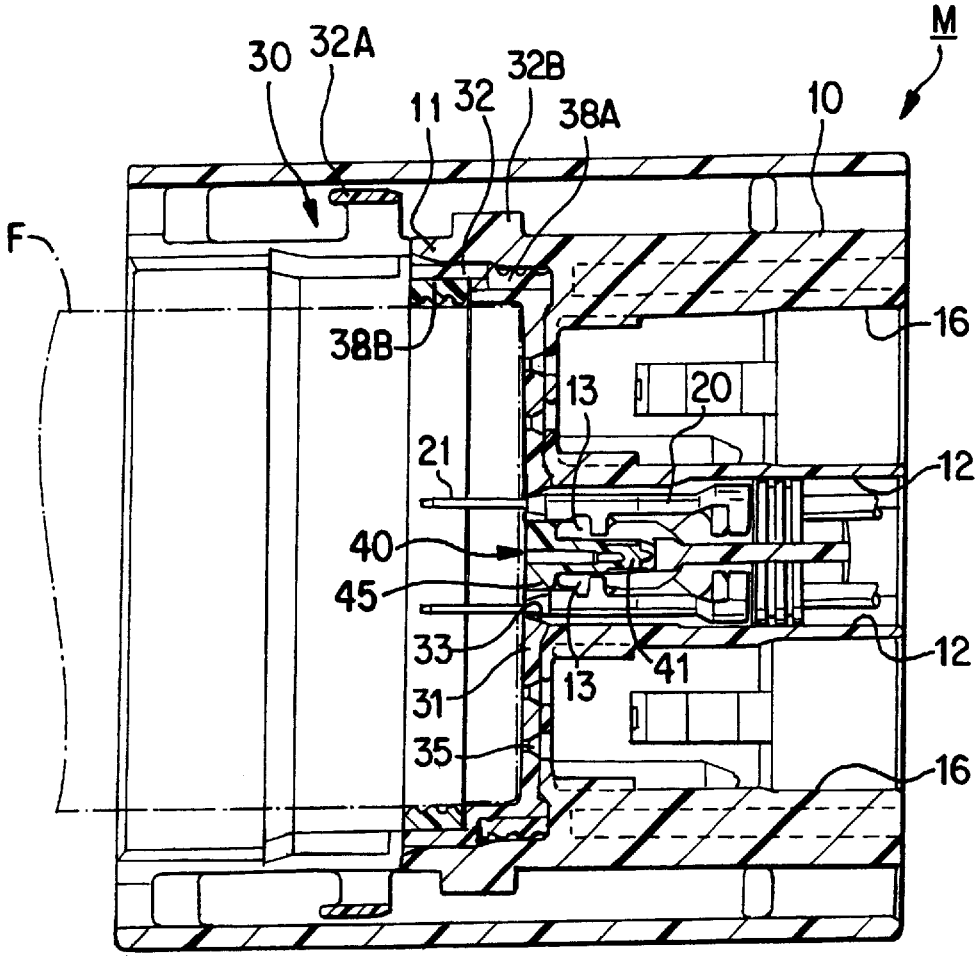
FIG. 4 is a horizontal cross-sectional view showing a connector fitted with a corresponding connector.
Figure 5:
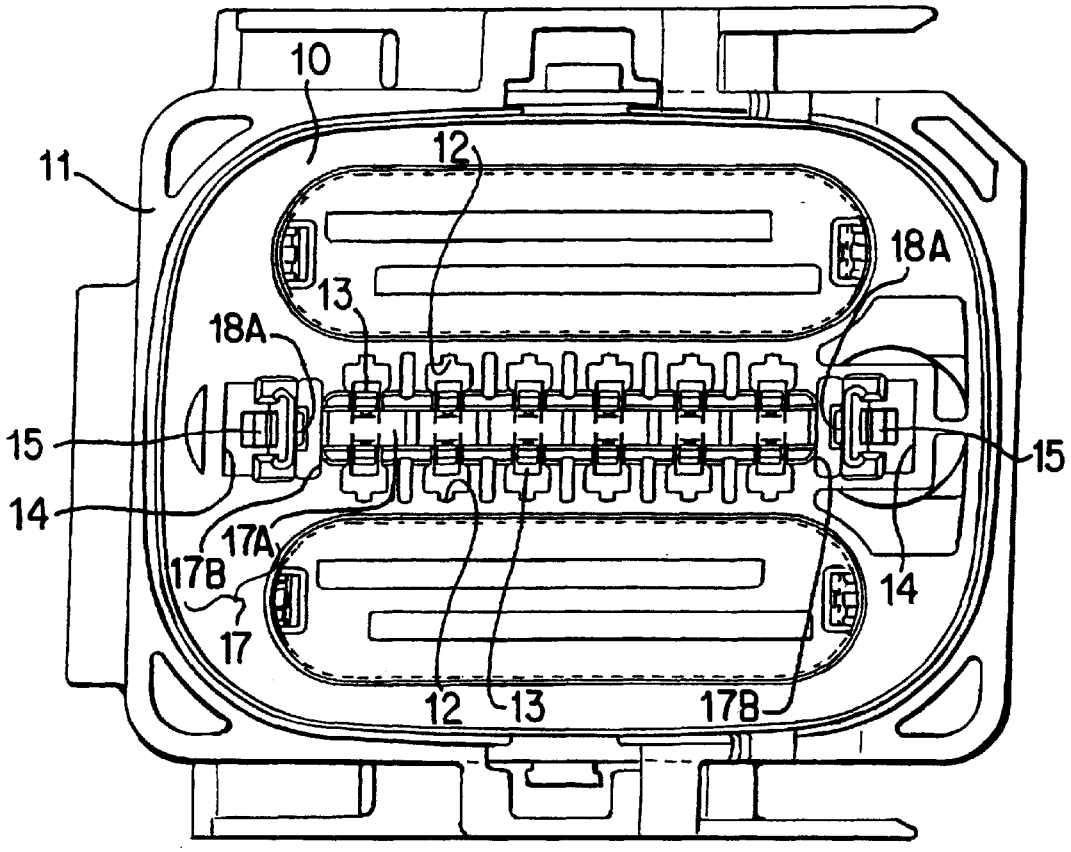
FIG. 5 is a front view of a connector housing.
Figure 8:
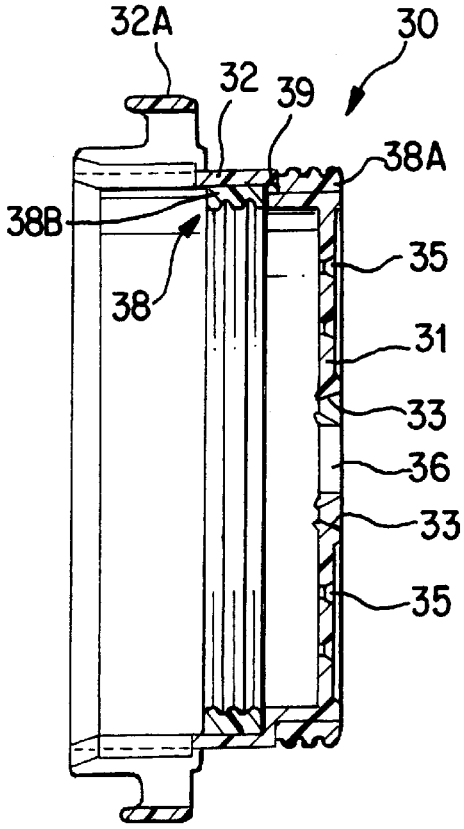
FIG. 8 is a vertical cross-sectional view of the moving plate.
Figure 9:
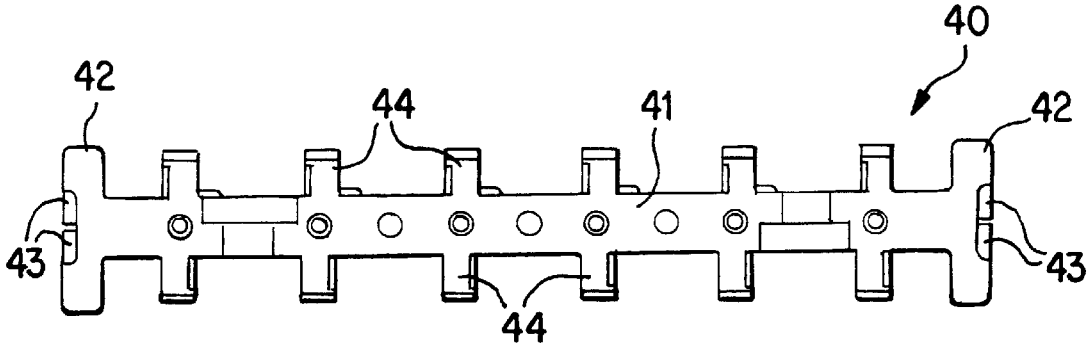
FIG. 9 is a front view of the retainer.
Figure 10:
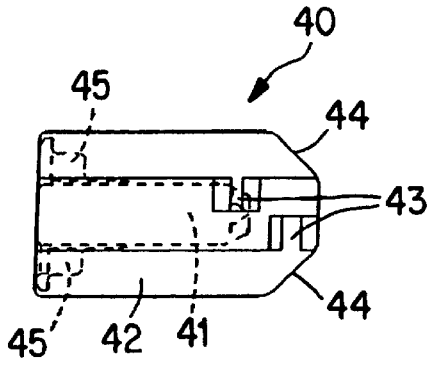
FIG. 10 is a side face view of the retainer.
Figure 11:
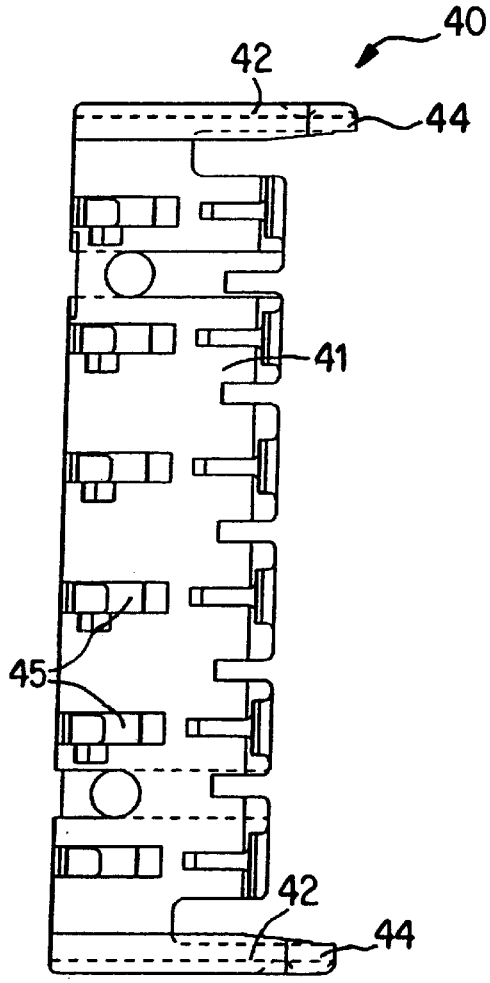
FIG. 11 is a plan view of the retainer.
Figure 12:
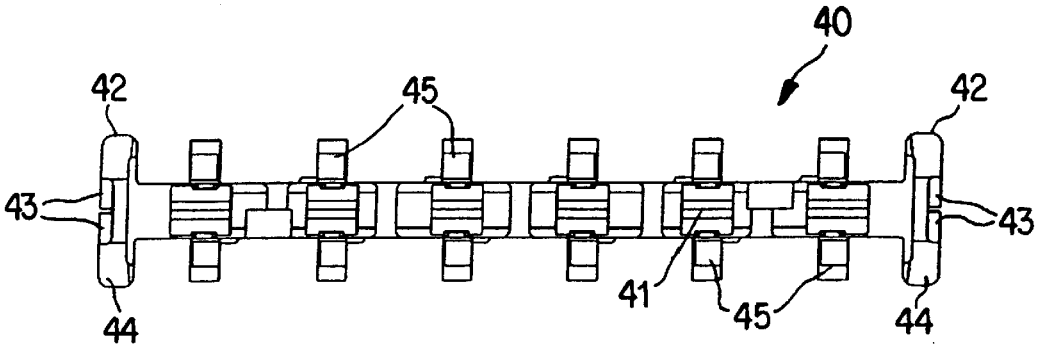
FIG. 12 is a rear face view of the retainer.
Figure 13:
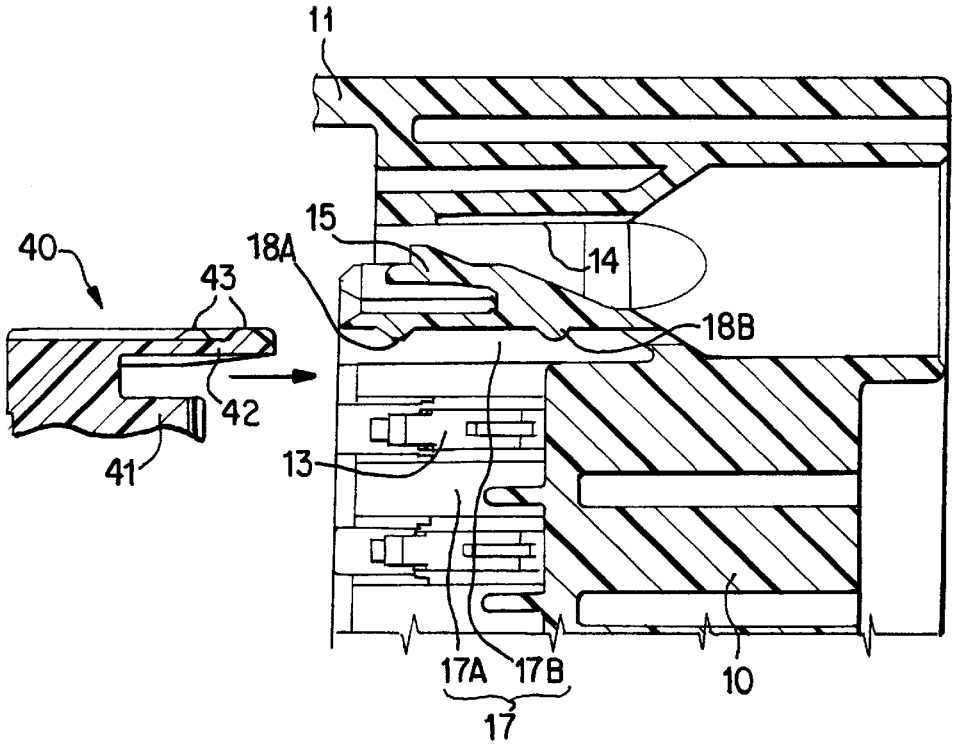
FIG. 13 is a partially enlarged horizontal cross-sectional view showing the retainer in a removed state.
Figure 14:
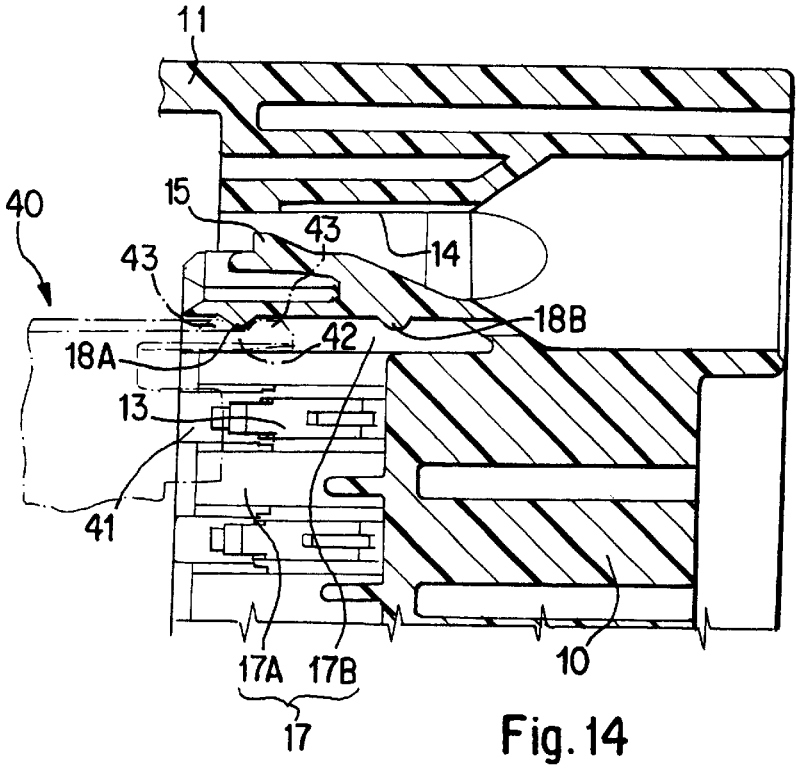
FIG. 14 is a partially enlarged horizontal cross-sectional view showing the retainer in the temporary retaining state.
Figure 15:
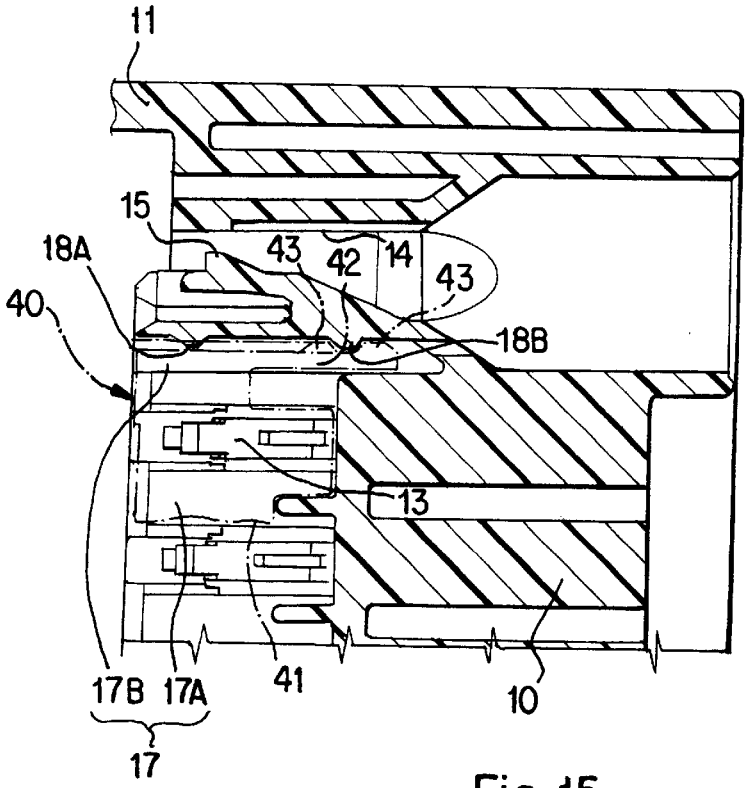
FIG. 15 is a partially enlarged horizontal cross-sectional view showing the retainer in the main retaining state.

As shown in FIG. 4, when the corresponding connector F is in a fitted state, the outer circumference sealing member 38A of the moving plate 30 fits tightly with the inner circumference of the hood 11, thereby waterproofing the space between the moving plate 30 and the hood 11. Furthermore, the inner circumference sealing member 38B of the moving plate 30 fits tightly with an outer circumference of the corresponding connector F, thereby waterproofing the space between the moving plate 30 and the corresponding connector F. The sealing member 38 thus seals the space between the hood 11 and the corresponding connector F. Moreover, the retainer attachment hole 17 is located inwards relative to the anterior end face of the connector housing 10 on which the sealing member 38 is located. Consequently, the retainer attachment hole 17 is also waterproofed by the sealing member 38.

In the embodiment described above, the moving plate 30 has the window hole 36 formed therein. The retainer 40 protrudes towards the anterior via this window hole 36, this allowing the retainer 40 is be pushed (from the temporary retaining position to the main retaining position) from the anterior of the moving plate 30. That is, the retainer 40 can be attached from the anterior relative to the connector housing 10. Furthermore, the retainer 40 can pass in an anterior-posterior direction through the window hole 36 of the moving plate 30. Consequently, the retainer 40 can be attached after the moving plate 30 has been attached within the hood 11. In the present embodiment, the moving plate 30 is attached first, then the retainer 40 is attached thereafter. However, the retainer 40 may equally well be attached first, and the moving plate 30 attached thereafter.

Since the moving plate 30 has the window hole 36 formed therein, the retainer 40 can be attached from the anterior. This means that the connector housing 10 requires no opening on its outer side face for attaching the retainer 40. Further, the retainer attachment hole 17 is located in the anterior end face of the connector housing 10 (i.e., with the hood 11). Consequently, the fitting portion of the corresponding connector F and the retainer attachment hole 17 can simultaneously be waterproofed merely by providing the sealing member 38 between the hood 11 and the corresponding connector F.

The retainer 40 is provided with the guiding members 42 which are inserted prior to the removal preventing member 41 when the retainer 40 is inserted into the retainer attachment hole 17. Consequently, the guiding members 42 are inserted first into the retainer attachment hole 17 when the retainer 40 is being attached, this stabilising and maintaining the position of the retainer 40 relative to the connector housing 10. By this means, the retainer 40 can be attached smoothly and reliably.

The guiding members 42 are provided as a pair, one at either end of the removal preventing member 41. Consequently, the retainer 40 is less likely to become inclined than in the case where a guiding member is provided on only one end. Further, the tapered guiding tips 44 are formed at the tip ends of the guiding members 42. These simplify the insertion of the guiding members 42 into the retainer attachment hole 17.

The stopping members 43 are formed in the guiding members 42, these maintaining the retainer 40 in the temporary retaining position or the main retaining position. Consequently, the retainer 40, as a whole, is simpler and smaller than in the case where stopping members are provided in locations separate from the guiding members 42.

Furthermore, the present invention is not limited to the embodiments described above with the aid of figures. For example, the possibilities described below also lie within the technical range of the present invention. In addition, the prevent invention may be embodied in various other ways without deviating from the scope thereof.

(1) In the embodiment described above, the guiding members are provided at both ends of the stopping member. However, according to the present invention, a guiding member may equally well be provided at only one end, or in a central location.

(2) In the embodiment described above, the stopping members, for fixing the retainer in the temporary stopping position or the main retaining position, are formed in the outer side faces of the guiding members. However, according to the present invention, the stopping members may equally well be formed in inner side faces of the guiding members, or at locations separate from the guiding members.

(3) In the embodiment described above, an example was described which was suitable for a connector provided with a moving plate. However, the present invention can be made equally suitable for a connector which is not provided with a moving plate.

(4) In the embodiment described above, an example was described which was suitable for a lever-type connector. However, the present invention can be made equally suitable for a connector which is not a lever-type connector.

(5) In the embodiment described above, an example was described which was suitable for a waterproof connector. However, the present invention can be made equally suitable for a connector which is not a waterproof connector.

What is claimed is:

1. An electrical connector comprising a housing having a first end face and an opposing second end face, a terminal fitting positioned within said housing and being exposed at said first end face of said housing for connection to a corresponding terminal of a mating connector that is insertable through said first end face, a plate including an opening and a plurality of terminal receiving holes positioned within said housing, and a retainer insertable into a retainer attachment hole of said housing and said opening of said plate from said first end face to retain said terminal fitting in said housing, wherein said plate is moveable relative to both the housing and the retainer and said retainer has a plate-like preventing member for retaining said terminal fitting, and a protruding guiding member, said guiding member being adapted to enter said attachment hole in advance of said preventing member to stabilize said retainer therein during insertion.

2. A connector according to claim 1 wherein said guiding member includes a tapered entry end that enters said attachment hole in advance of said preventing member.

3. A connector according to claim 2 wherein said guiding member is tapered symmetrically on both sides of the entry end thereof.

4. A connector according to claim 1 wherein a said guiding member is provided on either side of said preventing member.

5. A connector according to claim 4 wherein said retainer is elongate and has a plurality of said preventing members side by side thereon, for retaining a plurality of terminal fittings in said housing.

6. A connector according to claim 5 wherein a said guiding member is provided at each end of said retainer.

7. A connector according to claim 1 wherein said guiding member includes a disengageable latching member thereon for engagement with said housing, said latching member maintaining said retainer at a predetermined insertion depth in said attachment hole.

8. A connector according to claim 7 wherein said guiding member is resilient and comprises said latching member.

9. A connector according to claim 8 wherein said latching member is engageable with said housing at two insertion depths so as to provide a waiting position at which said terminal is not retained and a retaining position.

10. A connector according to claim 1 wherein said housing has upper and lower terminal fittings, and said retainer preventing member is insertable between said upper and lower terminal fittings to retain said fittings in said housing.

11. A connector according to claim 1 wherein said protruding guiding member has a greater length than said preventing member.

12. An electrical connector comprising a housing having a first end face and an opposing second end face, a terminal fitting positioned within said housing, said terminal fitting being inserted within said housing from a first direction through said second end face, a plate including an opening and a plurality of terminal receiving holes positioned within said housing, and a retainer insertable through said first end face and into a retainer attachment hole of said housing and through said opening of said plate from a second direction to retain said terminal fitting in said housing, said second direction being opposite said first direction, wherein said plate is moveable relative to both the housing and the retainer and said retainer has a plate-like preventing member for retaining said terminal fitting, and a protruding guiding member, said guiding member being adapted to enter said attachment hole in advance of said preventing member to stabilize said retainer therein during insertion.

* * * * *

UNITED STATES PATENT AND TRADEMARK OFFICE

CERTIFICATE OF CORRECTION

PATENT NO. : 6,607,407 B2
DATED : August 19, 2003
INVENTOR(S) : Kozue Takatsuki et al.

It is certified that error appears in the above-identified patent and that said Letters Patent is hereby corrected as shown below:

Title page,
Item [56], References Cited, U.S. PATENT DOCUMENTS,
-- 6,089,927 7/2000 Seko et al. -- has been inserted.

Signed and Sealed this

Third Day of February, 2004

JON W. DUDAS
*Acting Director of the United States Patent and Trademark Office*